United States Patent [19]

Mewborne

[11] Patent Number: 4,722,577

[45] Date of Patent: Feb. 2, 1988

[54] CABINET FOR HOUSING DISPENSING MACHINES

[75] Inventor: D. William Mewborne, 953 18th Ave. South, Naples, Fla. 33940

[73] Assignee: D. William Mewborne, T.T.E.E., Naples, Fla.

[21] Appl. No.: 927,349

[22] Filed: Nov. 6, 1986

[51] Int. Cl.[4] ..... A47B 81/00

[52] U.S. Cl. ..... 312/290; 312/317 R; 211/15

[58] Field of Search ..... 211/4, 8, 15; 312/290, 312/317 R, 317 A, 132, 126; 108/93, 143

[56] References Cited

U.S. PATENT DOCUMENTS

| | | | |
|---|---|---|---|
| 739,725 | 9/1903 | Schriefer | 312/107 |
| 827,050 | 7/1906 | Weston | 108/93 X |
| 1,245,022 | 10/1917 | Piggot | 312/333 X |
| 1,606,025 | 11/1926 | Gruendler | 312/317 A |
| 2,662,989 | 12/1953 | Thatcher | 312/290 X |
| 4,482,066 | 11/1984 | Dykstra | 211/151 |

*Primary Examiner*—Joseph Falk

*Attorney, Agent, or Firm*—David M. Carter

[57] ABSTRACT

There is provided an improved cabinet for housing a plurality of dispensing machines which are situated in rows and columns within the cabinet. The bottom row of dispensing machines are received on a slidable support mechanism so that the bottom row may be moved from underneath the top row thus exposing the lids of the machines on the bottom row enabling convenient access for servicing. Vertical supports are provided to stabilize the cabinet while the bottom row of machines are being serviced. The cabinet includes an openable top so that the top row of machines also may be readily serviced.

8 Claims, 6 Drawing Figures

CABINET FOR HOUSING DISPENSING MACHINES

BACKGROUND OF THE INVENTION

This invention relates to structures for supporting a plurality of dispensing machines. More particularly, it relates to cabinets for housing dispensing machines whereby the dispensing machines may be conveniently and safely used and serviced.

Businesses which are exposed to high volumes of consumer traffic often find it convenient and profitable to utilize coil operated dispensing machines to provide consumers with products without the need for a sales person to be on hand for each transaction. These dispensing machines, which are often called vending machines, house such items as chewing gum, candy, nuts and novelty items.

It has been found that it is advantageous to include a plurality of such dispensing machines together on a single rack thereby offering the consumer a wide selection of products at a single location. Furthermore, by providing a group of machines at a single location, it is much more efficient to service the machines, that is, to add more goods to the machines as well as to remove the coins from the machines.

In order to efficiently provide for these groups of machines, racks have been developed to support the machines. An example of such a prior art rack may be seen in reference to FIG. 1. As can be seen rack 10 supports a first plurality of machines 12 by upper support 14 and a second plurality of machines 16 by lower support 18. The supports 14 and 18 and thus the plurality machines 12 and 16 are offset from one another so that the lids on the machines, which are removable by use of a key, are readily accessed by the person who services the machines. If the machines were simply stacked vertically upon each other it would be very difficult to service the bottom machines without removing each of the bottom machines from their position.

The prior art rack shown in FIG. 1 is froth with problems. Because of the offset of the top machines from the bottom machines it is often very difficult for the consumer to reach the top machines since he or she will bump into the bottom row of machines. Furthermore, because of this offset relationship the center of gravity of the overall structure is such that the machines have been known to tip over presenting a safety problem. This safety problem is particularly acute when small children crawl underneath the space created below the bottom row of machines and thus could become injured not to mention damage to the dispensing machines.

OBJECTS OF THE INVENTION

It is therefore one object of this invention to provide an improved means for housing a plurality of dispensing machines.

It is another object to provide a support structure for housing dispensing machines which enables access to the machines for servicing and is convenient for use by the consumer and is safe.

It is still another object to provide an improved structure for supporting the plurality of dispensing which is not proned to be tipped over.

SUMMARY OF INVENTION

In accordance with one form of this invention there is provided a cabinet for housing a plurality of dispensing machines. The cabinet includes a hollow upright box-shaped structure having a substantially open front. The structure includes an upper portion and a lower portion. A first horizontal support mechanism is located at the bottom of the upper portion of the structure. The first horizontal support mechanism provides support for a first plurality of dispensing machines which are housed in the upper portion of the structure. The structure includes a second horizontal support mechanism located near the bottom of the lower portion of the structure for providing movable support for a second plurality of dispensing machines. Portions of the second support mechanism is enabled to extend out of the open front of the structure thus portions of the second plurality of the dispensing machines may be extended out of the open front of the structure. Easy access is therefore provided to the lips of all of the dispensing machines for servicing. Preferably, an additional support is provided to prevent the cabinet from tipping over while the lower row of machines are being serviced. In particularly a support leg for the second horizontal support mechanism extends down to contact the floor when the second horizontal support mechanism extends out of the opening. Also an enlarged bottom for the cabinet may be provided for further stability.

BRIEF DESCRIPTION OF THE DRAWINGS

The subject matter which is regarded as the invention is set forth in the appended claims. The invention itself together with further advantages therein may be better seen in reference to the following description taken in conjunction with the accompanying drawings in which:

DESCRIPTION OF THE PREFERRED EMBODIMENT

Figure 1:
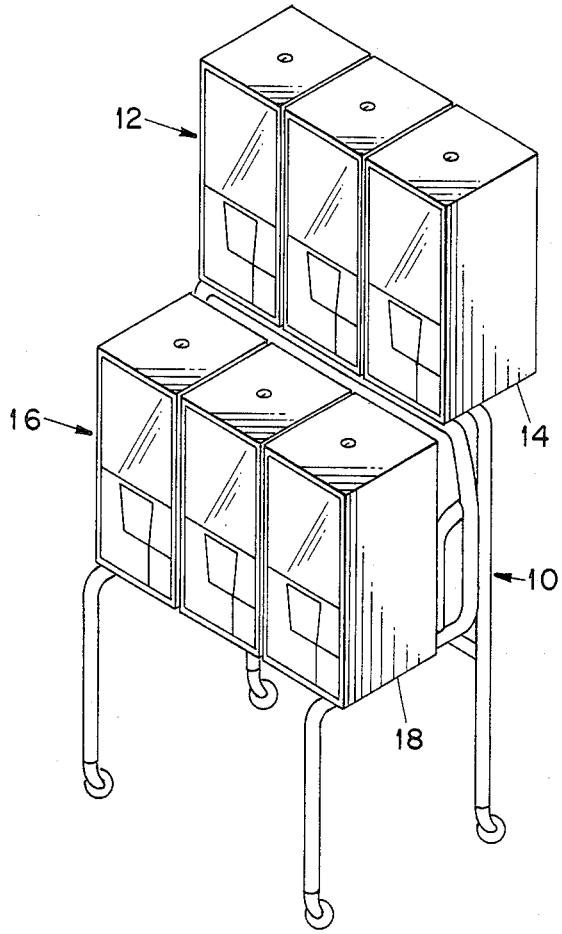
FIG. 1 PRIOR ART
FIG. 1 is a perspective view of a prior art stand for housing a plurality of dispensing machines.
Figure 2:
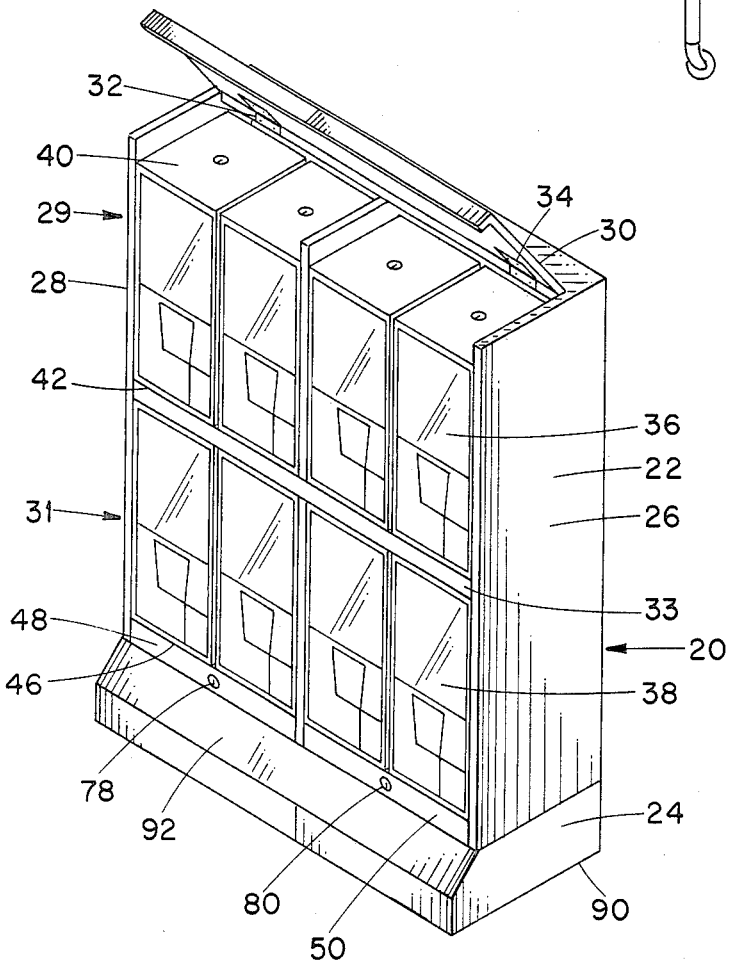
FIG. 2 is a perspective view of the cabinet of the subject invention with the bottom row of dispensing machines being fully inside the cabinet and with the top of the cabinet being open.

Referring now more particularly to FIG. 2 there is provided cabinet 20 including hollow upright box shaped structure 22 resting on support member 24. Structure 22 is divided into an upper portion generally indicated at 29 and a lower portion generally indicated at 31. The upper and lower portions are divided by bar 33. As can be seen the front of the structure is substantially open. Structure 22 is primarily made of sheet metal and includes solid sides 26 and 28 and a solid back (not shown) as well as solid top 30. Top 30 is attached to structure 22 by means of hinges 32 and 34.

The cabinet is adapted to house a plurality of dispensing machines. A top row 36 of dispensing machines is received over bottom row 38 and the front faces of all of the machines are aligned with one another during normal operation of the cabinet and the machines. The lids 40 of each of the top row of the machines are exposed when the top 30 of the structure is in the open position thus permitting a person to service the machines when the lids are removed, that is the person can add candy or whatever other products to the machines. The top 30 is closed during normal operation as shown in FIG. 3, thus protecting the machines from the elements and presenting an attractive appearance.

The top row of dispensing machines 36 are supported by solid horizontal support structure 42 which is located at the bottom of the top portion 29 of the cabinet. Support structure 42 may be better seen in reference to FIG. 4. Support structure 42 may be bolted or otherwise affixed to the sides 26 and 28 and the back of the cabinet.

A second plurality of dispensing machines 38 are received in the lower portion 31 of the cabinet resting upon a second support horizontal support means generally indicated as 46 in FIG. 2. In the preferred embodiment the second horizontal support means includes a pair of trays 48 and 50 which are slidably received on rails 52, 54, 56 and 58 all of which are attached to the cabinet.

Figure 3:
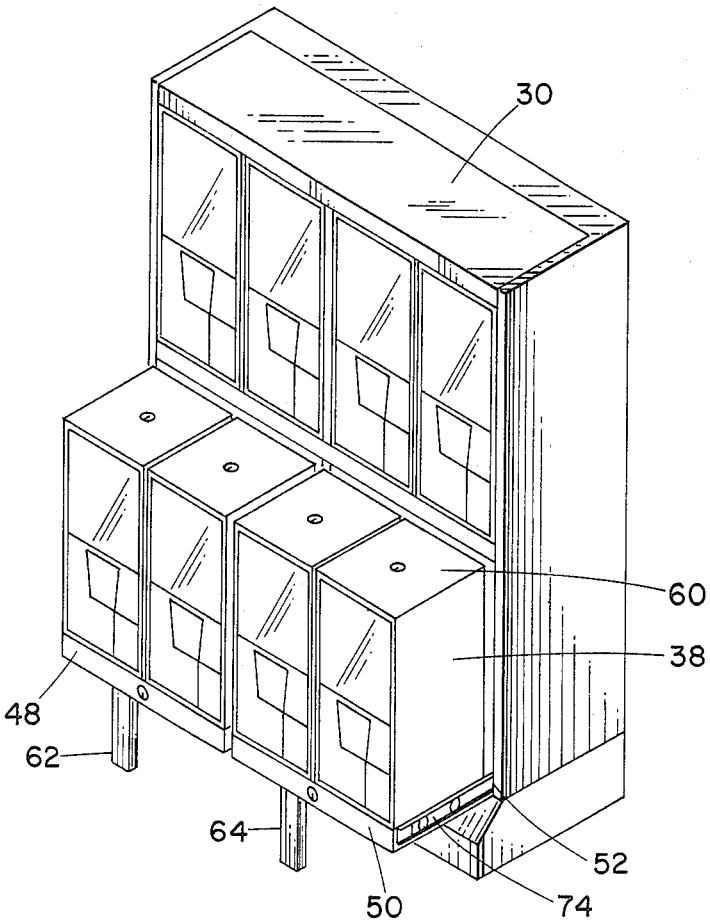
FIG. 3 is a perspective view of the cabinet of FIG. 1 with the top closed and with the bottom row of dispensing machines extending out from the cabinet.

As can be seen in FIG. 3 trays 48 and 50 may slide out through the open front of the cabinet thus exposing the lids 60 of the lower dispensing machines 38 so that the machines may be readily serviced by simply removing the lids and inserting additional goods therein.

By operating the trays 48 and 50 independently of one another, the machine on the respective trays may be serviced separately from each other. While one tray is in the out position, the other tray may be in the in position so that the weight in the cabinet stays more evenly distributed reducing the chances of the cabinet falling forward during servicing.

Figure 5:
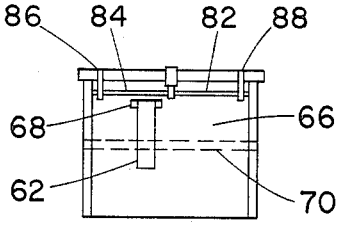
FIG. 5 is a bottom view of one of the lower supporting trays of the cabinet of FIG. 2 with the tray being in the inside position.
Figure 4:
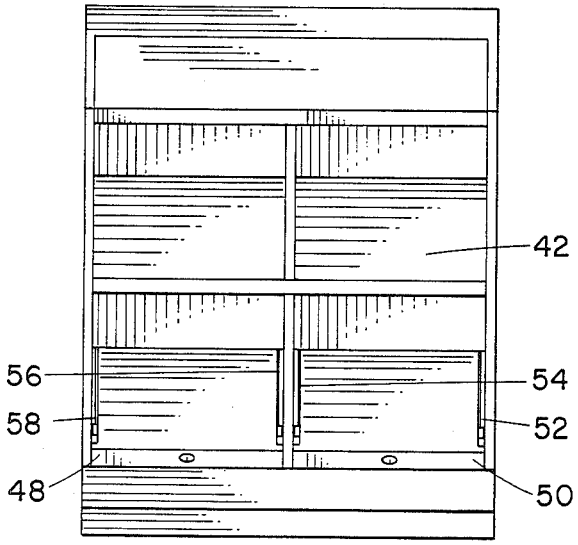
FIG. 4 is an angled view of the embodiment of FIG. 3 showing the top and the front, however, with the dispensing machines having been removed.
Figure 6:
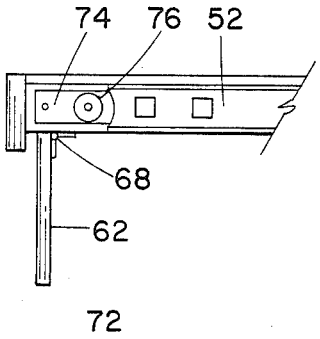
FIG. 6 is a partial side elevational view of the tray of FIG. 5 however, with the tray being in the outside position.

Furthermore, when the trays are in the out position vertical support rods 62 and 64 automatically drop to the vertical position from the bottom 66 of the trays which is better seen in reference to FIG. 5 which shows the bottom of one of the trays each of which are identical. In FIG. 5 rod 62 is shown its up position while the tray is fully inside the cabinet. Rod 62 is mounted on hinge 68 and drops freely when not inhibited by crossbar 70 which is a part of the cabinet and is not connected to the tray. FIG. 6 shows a side view of one of the trays with the support rod 62 in the vertical position. Because the tray is in its out position, that is outside of the open front space of the cabinet, the end of 72 of each rod is adapted to contact the ground or floor in front of the cabinet. The rods 62 and 64 provide support for the trays while they are in the out position and thus provide additional support for the entire cabinet. As can be better seen from FIGS. 3 and 6 each of the trays, 48 and 52, have side rails 74 attached thereto on each side thereof. The side rails 74 are slidably received within rails 52, 54, 56 and 58 which are affixed to the cabinet as shown in FIG. 4. Plastic bearings 76 is provided within the channels of the rails 74 and the rails 52, 54, 56 and 58 to enhance the sliding of the trays in a similar construction to standard commercially available file cabinet sliding mechanisms.

Each tray also includes locking mechanisms 78 and 80. The locking mechanism that are better seen in reference to FIG. 5 which shows a pair of slide bars 82 and 84 which engage lips 86 and 88 when in a locked position. When in the unlocked position the bars 82 and 84 slide past lips 86 and 88 permitting the drawers to be opened. This feature prevents the trays from being pulled out by an unauthorized person and is another safety feature.

As can be seen in FIG. 2 the bottom 90 of the support member 24 of the cabinet has a surface area much larger than the top 30. This feature again will provide for additional stability for the cabinet. Furthermore, space is provided between the trays 48 and 50 and the bottom 90 because of the front part of the support member 24 is tapered at an angle as indicated by slope 92.

Thus there is provided a cabinet for housing a plurality of dispensing machines which is stable and is attractive in appearance and provides for ease of servicing the machines without inhibiting the customers use of the machines.

From the foregoing description of the preferred embodiment of the invention it will be apparent that many modifications may be made therein without departing from the true spirit and scope of the invention.

I claim:

1. A multiple machine dispensing apparatus comprising:

a cabinet, a first and second plurality of dispensing machines forming top and bottom rows housed by said cabinet;

said dispensing machines having openable tops;

said cabinet being formed as a hollow upright box shaped structure;

said cabinet having a substantially open front;

said cabinet being substantially closed on its two sides and on its rear;

said cabinet having an openable top;

said cabinet having an upper portion and a lower portion;

first horizontal nonmovable support means fixedly supporting said first plurality of dispensing machines in said upper portion;

a second horizontal movable support means located near the bottom of said lower portion;

said second horizontal movable support means movably supporting said second plurality of dispensing machines located in said lower portion;

said dispensing machines being supported only on two levels within said cabinet;

portions of said second movably horizontal support means and portions of said second plurality of dispensing machines enabled to extend out of the open front of said cabinet whereby at least portions of said tops of said second plurality of dispensing machines may extend out of open front of said cabinet wherein said tops of said second plurality of dispensing machines may be opened for servicing said second plurality of dispensing machines; said bottom row extending from said movable support means to a place below said nonmovable support means; said top row extending from said nonmovable support means to a place below said openable top; access to said tops of said first plurality of dispensing machines in said top row is only allowed when said openable top is open, and access to said tops of said second plurality of dispensing machines in said bottom row is only allowed when said movable support means is moved.

2. A dispensing apparatus as set forth in claim 1 wherein said structure includes a hinged top adapted to be opened exposing the tops of the first plurality of dispensing machines for ease of servicing and also providing protection for the dispensing machines when said top is in the closed position.

3. A dispensing apparatus as set forth in claim 1 further including at least one vertical support means attached to the bottom of said second horizontal support means.

4. A dispensing apparatus as set forth in claim 3 wherein said vertical support means is hinged whereby when said second hortizontal support means does not extend outside said open front said vertical support means lies against the bottom of said second support means, and when said second horizontal support means is extended out of said open front said vertical support means projects vertically down from the bottom of said second support means for contacting the supporting surface of said cabinet for stabilizing said second support means and said cabinet.

5. A dispensing apparatus as set forth in claim 4 wherein said second horizontal support means is a pair of trays; said vertical support means being on the bottom of each tray; said trays enabled to slide independently of one another.

6. An dispensing apparatus as set forth in claim 5 further including a lock means on each tray to prevent unauthorized sliding of each of said trays.

7. A dispensing apparatus as set forth in claim 1 wherein the bottom of said cabinet has a larger surface area than said top; said bottom extending beyond the open front of said structure.

8. An dispensing apparatus as set forth in claim 7 further including a support stand at the bottom of said cabinet connected to said hollow box-shaped structure; a tapered portion extending from the front of said support stand toward said second horizontal support means.

* * * * *